US009529313B2

(12) United States Patent
Fukai

(10) Patent No.: US 9,529,313 B2
(45) Date of Patent: Dec. 27, 2016

(54) IMAGE FORMING APPARATUS WITH A GUIDE MEMBER DISPOSED ALONG THE SHEET FEEDING PATH ON BOTH SIDES

(71) Applicant: Konica Minolta, Inc., Chiyoda-ku, Tokyo (JP)

(72) Inventor: Shougo Fukai, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/645,747

(22) Filed: Mar. 12, 2015

(65) Prior Publication Data

US 2015/0261156 A1 Sep. 17, 2015

(30) Foreign Application Priority Data

Mar. 13, 2014 (JP) ..... 2014-050631

(51) Int. Cl.
*G03G 15/00* (2006.01)

(52) U.S. Cl.
CPC ..... *G03G 15/6517* (2013.01); *G03G 15/652* (2013.01)

(58) Field of Classification Search
CPC ..... G03G 15/6517; G03G 15/652; G03G 15/6523; G03G 2215/00455; B65H 23/0204; B65H 23/0208; B65H 23/0212; B65H 23/0216; B65H 23/032; B65H 23/0322; B65H 23/0324; B65H 23/035; B65H 23/038
See application file for complete search history.

(56) References Cited

U.S. PATENT DOCUMENTS

RE32,967 E * 6/1989 St. John ..... B41F 13/025 226/10
2011/0266742 A1* 11/2011 Sato ..... B65H 5/36 271/228
2012/0039649 A1* 2/2012 Brewington ..... G03G 15/2017 399/333
2012/0081715 A1* 4/2012 Takano ..... G06K 15/16 358/1.5

FOREIGN PATENT DOCUMENTS

JP 2006188352 A 7/2006

* cited by examiner

*Primary Examiner* — Blake A Tankersley
(74) *Attorney, Agent, or Firm* — Cantor Colburn LLP

(57) ABSTRACT

An image forming apparatus includes: a sheet feeding section configured to feed a roll sheet; a sheet feeding path along which a roll sheet is conveyed; an image forming section configured to transfer a toner image to a roll sheet; a fixing section configured to fix the toner image by applying heat and pressure to a roll sheet on which the toner image is transferred at a fixing nip; a winding section configured to wind up a roll sheet; a guide member disposed along the sheet feeding path on both sides in a sheet width direction and on a downstream side of the fixing nip in a sheet conveyance direction; and a guide adjusting section configured to adjust a guide width of the guide member in accordance with an amount of shrinkage or an amount of expansion of a roll sheet passed through the fixing nip.

4 Claims, 6 Drawing Sheets

IMAGE FORMING APPARATUS WITH A GUIDE MEMBER DISPOSED ALONG THE SHEET FEEDING PATH ON BOTH SIDES

CROSS REFERENCE TO RELATED APPLICATIONS

The present invention claims priority under 35 U.S.C. §119 to Japanese Application No. 2014-050631, filed on Mar. 13, 2014, the entire content of which is incorporated herein by reference.

BACKGROUND OF THE INVENTION

Field of the Invention

The present invention relates to an electrophotographic image forming apparatus for forming an image on a roll sheet.

Description of Related Art

In general, an electrophotographic image forming apparatus (such as a printer, a copy machine, and a fax machine) is configured to irradiate (expose) a uniformly-charged photoconductor (for example, a photoconductor drum) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet through an intermediate transfer belt, followed by heating and pressurization for fixing, whereby an image is formed on the sheet.

It is known that sheets are conveyed in a tilted state (so-called skew or meandering) in such an image forming apparatus due to a slight inclination of a conveyance roller shaft, a difference in a nip pressure (hereinafter referred to as "conveyance nip pressure") between a plurality of roller pairs in the sheet feeding path section, or other reasons. In particular, when the meandering occurs during image formation on a roll sheet, the sheet is continuously conveyed through a conveyance nip in a tilted state, and consequently, not only deviation of the image formation region, but also damages such as paper wrinkle may possibly be caused. Conventionally, the meandering of a roll sheet is prevented by pushing the guide member from the both sides of the roll sheet in the sheet width direction (the direction orthogonal to the sheet conveyance direction) (for example, PTL 1: Japanese Patent Application Laid-Open No. 2006-188352).

However, since a guide member is fixed at a position set in advance, the technique disclosed in PTL 1 has the following problem. For example, when a roll sheet shrinks during a fixing process in image formation on the roll sheet, a gap is formed between a guide member and a roll sheet whose positions are set in advance, and thus the meandering which occurs after the fixation is facilitated. In addition, for example, when a roll sheet expands during a fixation process, the width of the roll sheet becomes larger than the guide width of the guide member whose position is set in advance, and thus the roll sheet may be deformed or lateral end portions of the roll sheet may be damaged. As a result, winding quality is degraded and irregularity of ends of the wound roll sheet is caused, which may possibly cause problems in subsequent steps.

SUMMARY OF THE INVENTION

An object of the present invention is to provide an image forming apparatus which can prevent meandering and deformation of a roll sheet after fixation, and can perform winding of a roll sheet in an orderly fashion without causing irregularity of ends of the sheet.

To achieve at least one of the abovementioned objects, an image forming apparatus reflecting one aspect of the present invention includes: a sheet feeding section configured to feed a roll sheet; a sheet feeding path along which a roll sheet fed from the sheet feeding section is conveyed; an image forming section configured to transfer a toner image to a roll sheet conveyed along the sheet feeding path; a fixing section configured to fix the toner image by applying heat and pressure to a roll sheet on which the toner image is transferred at a fixing nip; a winding section configured to wind up a roll sheet on which the toner image is fixed; a guide member disposed along the sheet feeding path on both sides in a sheet width direction and on a downstream side of the fixing nip in a sheet conveyance direction; and a guide adjusting section configured to adjust a guide width of the guide member in accordance with an amount of shrinkage or an amount of expansion of a roll sheet passed through the fixing nip.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, an embodiment of the present invention is described in detail with reference to the drawings.

Figure 1:
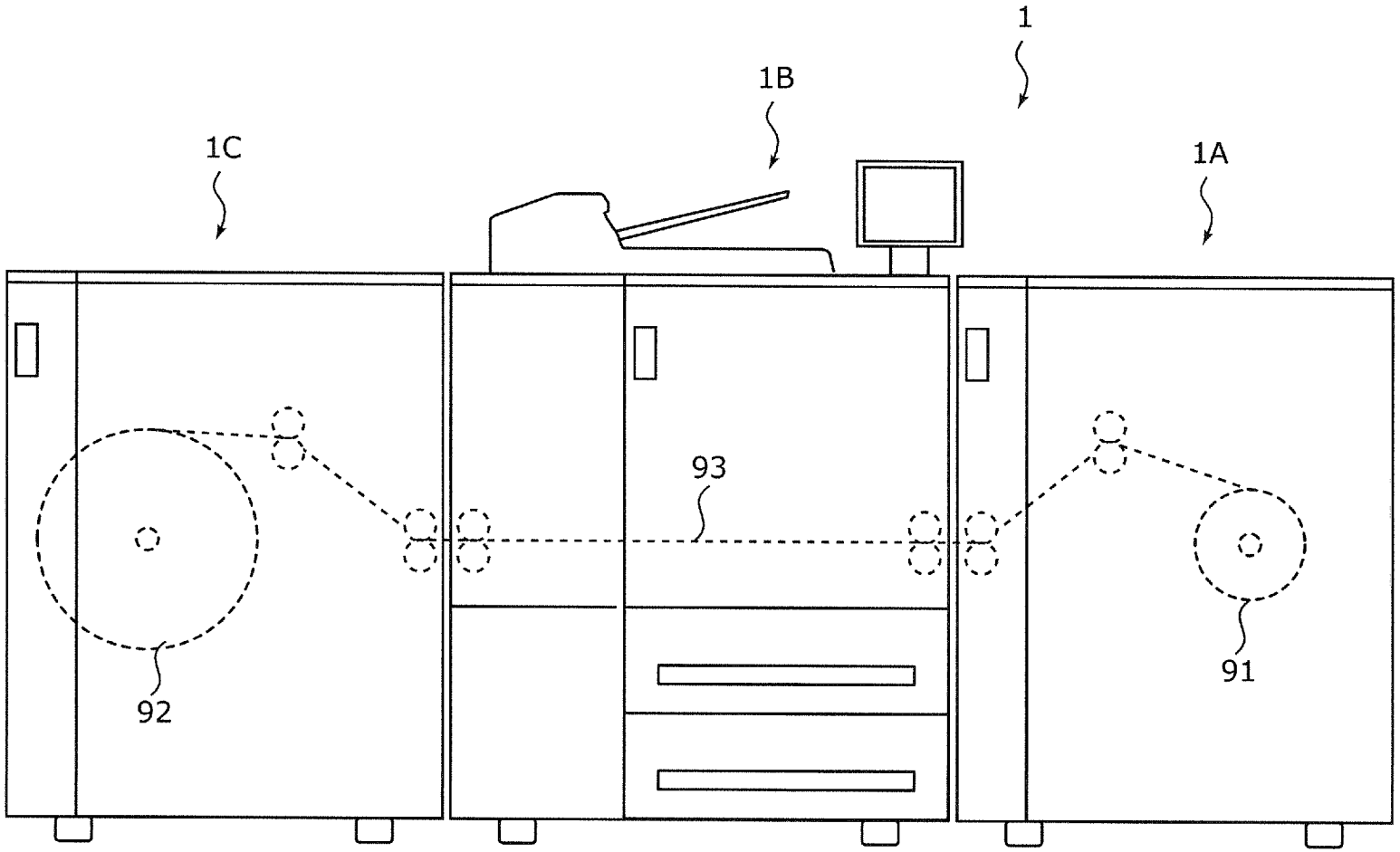
FIG. 1 illustrates an image forming apparatus according to an embodiment of the present invention.

FIG. 1 illustrates a configuration of image forming apparatus 1 according to the embodiment of the present invention.

Image forming apparatus 1 illustrated in FIG. 1 includes sheet feeding apparatus 1A, image forming apparatus main body 1B, and winding apparatus 1C.

Sheet feeding apparatus 1A includes roll sheet feeding section 91, and feeds sheets under the instruction of image forming apparatus main body 1B for example. The roll sheet fed from sheet feeding apparatus 1A is conveyed along sheet feeding path 93. Image forming apparatus main body 1B forms an image on a roll sheet fed from sheet feeding apparatus 1A. Winding device 1C includes roll winding section 92, and winds up an output roll sheet on which an image has been formed by image forming apparatus main body 1B.

It is to be noted that sheet feeding path 93 includes a sheet feeding path in sheet feeding apparatus 1A and a sheet feeding path in winding device 1C.

Figure 2:
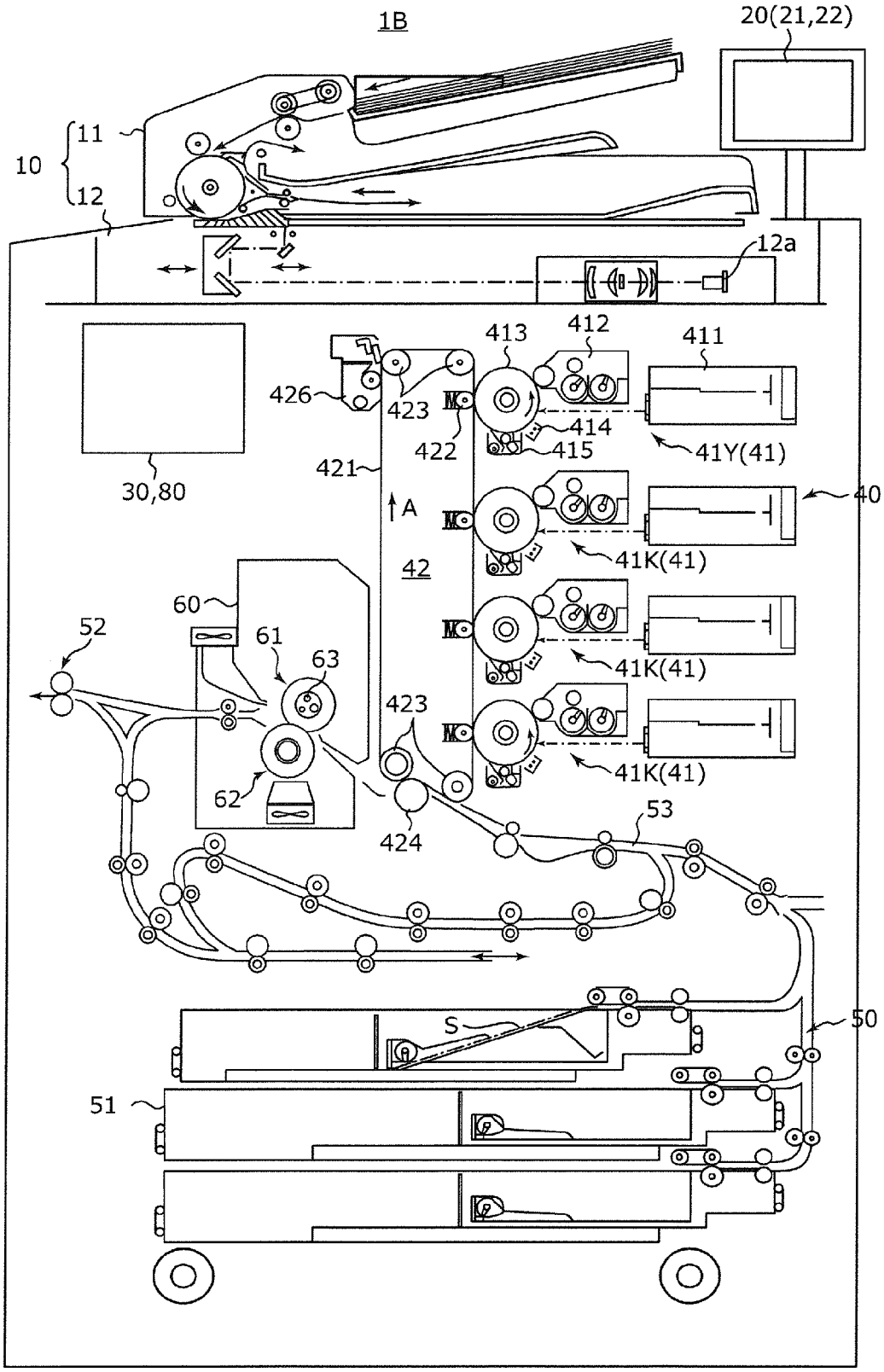
FIG. 2 illustrates a general configuration of an image forming apparatus main body.
Figure 3:
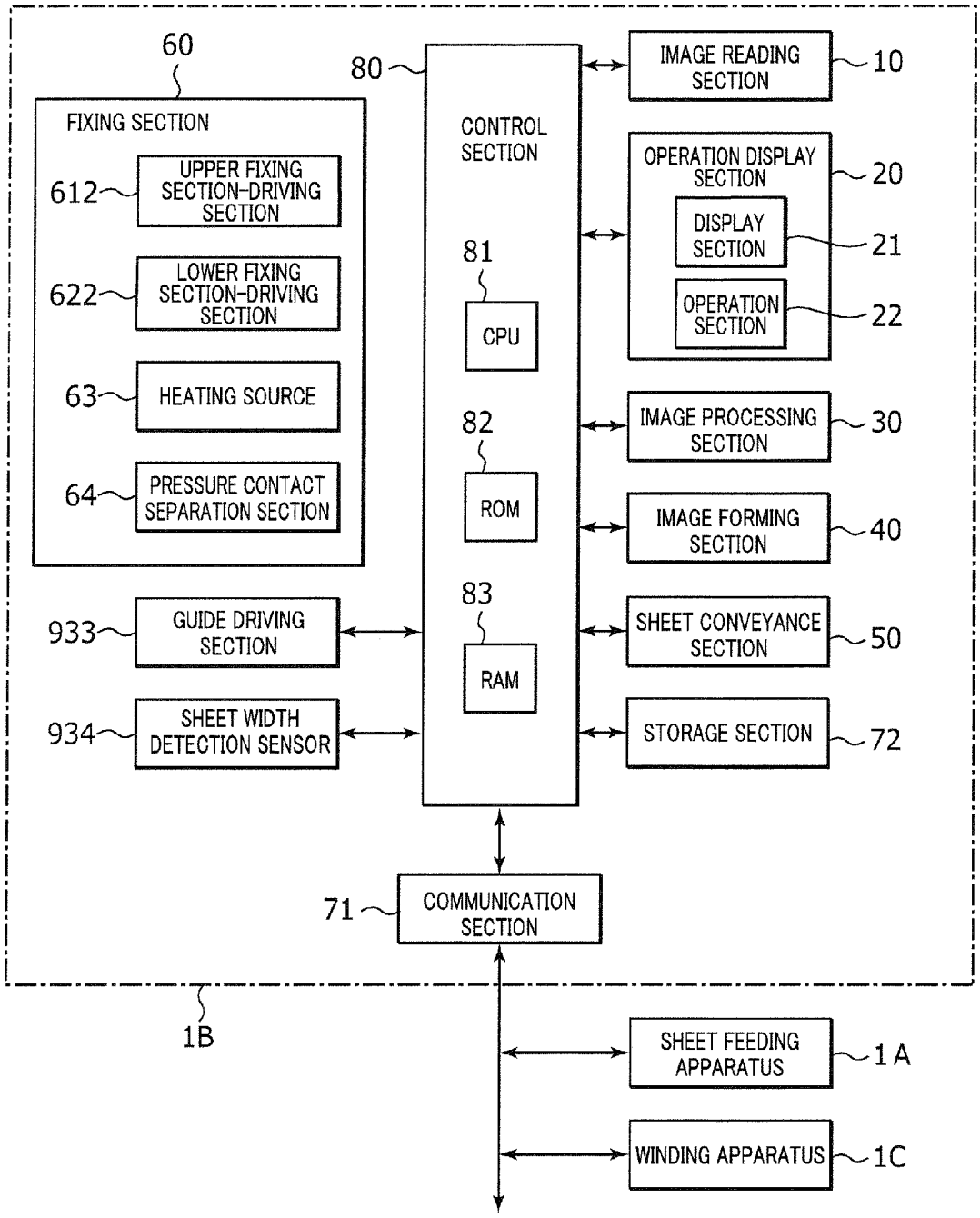
FIG. 3 illustrates a principal part of a control system of the image forming apparatus main body.

FIG. 2 illustrates a general configuration of image forming apparatus main body 1B. FIG. 3 illustrates a principal part of a control system of image forming apparatus main body 1B.

Image forming apparatus main body 1B illustrated in FIGS. 2 and 3 is a color image forming apparatus of an intermediate transfer system using electrophotographic process technology. A longitudinal tandem system is adopted for image forming apparatus main body 1B. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

That is, image forming apparatus main body 1B transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus main body 1B transfers (secondary-transfers) the resultant image to a sheet, to thereby form an image.

As illustrated in FIGS. 2 and 3, image forming apparatus main body 1B includes image reading section 10, operation display section 20, image processing section 30, image forming section 40, sheet conveyance section 50, fixing section 60, and control section 80.

Control section 80 includes central processing unit (CPU) 81, read only memory (ROM) 82, random access memory (RAM) 83 and the like. CPU 81 reads a program suited to processing contents out of ROM 82 or storage section 72, develops the program in RAM 83, and integrally controls the operation of each block of image forming apparatus 1B, sheet feeding apparatus 1A and winding apparatus 1C in cooperation with the developed program.

Communication section 71 has various interfaces such as network interface card (NIC), modulator-demodulator (MODEM), and universal serial bus (USB), for example. Storage section 72 is composed of, for example, a non-volatile semiconductor memory (so-called flash memory) or a hard disk drive.

Storage section 72 stores therein a look-up table which is referenced when the operation of each block is controlled, for example.

Control section 80 transmits and receives various data to and from an external apparatus (for example, a personal computer) connected to a communication network such as a local area network (LAN) or a wide area network (WAN), through communication section 71. Control section 80 receives image data (input image data) of page description language (PDL) that has been sent from an external device, and controls the apparatus to form an image on a sheet on the basis of the data, for example. In addition, control section 80 transmits and receives various data to and from sheet feeding apparatus 1A and winding apparatus 1C, through communication section 71.

Image reading section 10 includes auto document feeder (ADF) 11, document image scanner (scanner) 12, and the like.

Auto document feeder 11 causes a conveyance mechanism to feed documents placed on a document tray, and sends out the documents to document image scanner 12. Auto document feeder 11 enables images (even both sides thereof) of a large number of documents placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image conditions, operating statuses of functions, and the like in accordance with display control signals received from control section 80. Operation section 22 includes various operation keys such as numeric keys and a start key, receives various input operations performed by a user, and outputs operation signals to control section 80.

By operating operation display section 20, the user can perform setting relating to the image formation such as document setting, image quality setting, multiplying factor setting, application setting, output setting, single-sided/duplex printing setting, and sheet setting.

Image processing section 30 includes a circuit that performs a digital image process suited to initial settings or user settings on the input image data, and the like. For example, image processing section 30 performs tone correction on the basis of tone correction data (tone correction table), under the control of control section 80. Image processing section 30 also performs various correction processes such as color correction and shading correction as well as a compression process, on the input image data. Image forming section 40 is controlled on the basis of the image data that has been subjected to these processes.

Image forming section 40 includes: image forming units 41 for images of colored toners respectively containing a Y component, an M component, a C component, and a K component on the basis of the input image data; intermediate transfer unit 42; and the like.

Image forming unit 41 includes image forming units 41Y, 41M, 41C, and 41K for the Y component, the M component, the C component, and the K component, respectively. For ease of illustration and description, common elements are denoted by the same reference signs. Only when elements need to be discriminated from one another, Y, M, C, or K is added to their reference signs. In FIG. 2, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415, and the like.

Photoconductor drum 413 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Charging device 414 is composed of a corona discharging generator such as a scorotron charging device and a corotron charging device, for example. Charging device 414 evenly negatively charges the surface of photoconductor drum 413 by corona discharge.

Exposing device 411 is composed of, for example, an LED print head including an LED array having a plurality of linearly laid out light-emitting diodes (LED), an LPH driving section (driver IC) for driving each LED, and an lens array that brings light radiated from the LED array into an image on photoconductor drum 413, and the like. Each of the LEDs of LED array 1 corresponds to one dot of an image. Control section 80 controls the LPH driving section to cause a predetermined driving current to flow through the LED array, and thus designated LEDs emit light.

Exposure device 411 irradiates photoconductor drum 413 with light corresponding to the image of each color component. The positive charge generated in the charge generation layer of photoconductor drum 413 is transported to the surface of the charge transport layer, whereby the surface charge (negative charge) of photoconductor drum 413 is neutralized. Thus, an electrostatic latent image of each color component is formed on the surface of photoconductor drum 413 by the potential difference from its surroundings.

Developing device 412 stores developers of respective color components (for example, two-component developers composed of toner and magnetic carrier). Developing device 412 attaches the toners of respective color components to the surface of photoconductor drum 413, and thus visualizes the electrostatic latent image to form a toner image. To be more specific, a developing bias voltage is applied to a developer bearing member (developing roller), and, by the potential difference between photoconductor drum 413 and the developer bearing member, the charged toner on the developer bearing member is moved and attached to a light-exposed part on the surface of photoconductor drum 413.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, support roller 423 disposed on the downstream side in the belt travelling direction relative to primary transfer support rollers 422 for K-component is a driving roller. When driving roller rotates, intermediate transfer belt 421 travels in arrow A direction at a constant speed.

Primary transfer rollers 422 are disposed on the inner periphery side of intermediate transfer belt 421 in such a manner as to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed on the outer periphery side of intermediate transfer belt 421 in such a manner as to face one of support rollers 423. Support roller 423 that is so disposed as to face intermediate transfer belt 421 is called "backup roller." Secondary transfer roller 424 is brought into pressure contact with the backup roller with intermediate transfer belt 421 therebetween, whereby a secondary transfer nip for transferring a toner image from intermediate transfer belt 421 to a sheet is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when the sheet passes through the secondary transfer nip, the toner image on intermediate transfer belt 421 is secondary-transferred to the sheet. To be more specific, a secondary transfer bias is applied to secondary transfer roller 424, and an electric charge opposite to that of the toner is applied to the rear side (the side that makes contact with secondary transfer roller 424) of the sheet, whereby the toner image is electrostatically transferred to the sheet. The sheet on which the toner image has been transferred is conveyed toward fixing section 60.

Belt cleaning device 426 includes a belt cleaning blade configured to make sliding contact with the surface of intermediate transfer belt 421, and the like, and removes transfer residual toner remaining on the surface of intermediate transfer belt 421 after the secondary transfer.

Alternatively, in intermediate transfer unit 42, it is also possible to adopt a configuration (so-called belt-type secondary transfer unit) in which a secondary transfer belt is installed in a stretched state in a loop form around a plurality of support rollers including a secondary transfer roller in place of secondary transfer roller 424.

Fixing section 60 includes upper fixing section 61 having a fixing side member disposed on a fixing surface (the surface on which a toner image is formed) side of a sheet, lower fixing section 62 having a back side supporting member disposed on the rear surface (the surface opposite to the fixing surface) side of a sheet, heating source 63 configured to heat the fixing side member, pressure contact separation section 64 configured to bring the back side supporting member into pressure contact with the fixing side member, and the like.

For example, when upper fixing section 61 is of a roller heating type, the fixing roller serves as the fixing side member, and when upper fixing section 61 is of a belt heating type, the fixing belt serves as the fixing side member. In addition, for example, when lower fixing section 62 is of a roller pressing type, the pressure roller serves as the back side supporting member, and when lower fixing section 62 is of a belt pressing type, the pressing belt serves as the back side supporting member. The fixing side member and back side supporting member are also collectively called "fixing member."

FIG. 2 illustrates a configuration in which upper fixing section 61 is of a roller heating type, and lower fixing section 62 is of a roller pressing type. That is, in FIG. 4 described later, fixing roller 611 is a fixing side member, and pressure roller 621 is a back side supporting member.

Upper fixing section 61 includes upper fixing section-driving section 612 for rotating the fixing side member. When control section 80 controls the operation of upper fixing section-driving section 612, the fixing side member rotates (travels) at a predetermined speed. Lower fixing section 62 includes lower fixing section-driving section 622 for rotating the back side supporting member. When control section 80 controls the operation of the lower fixing section-driving section 622, the back side supporting member rotates (travels) at a predetermined speed. It is to be noted that, in the case where the fixing side member follows the rotation of the back side supporting member, the upper fixing section-driving section 612 is not required.

Heating source 63 is disposed inside or near the fixing side member. When control section 80 controls the output of heating source 63, the fixing side member is heated, and the fixing temperature is maintained at a predetermined temperature (for example, a fixable temperature, or a fixation idling temperature). On the basis of the detection result of a fixing temperature detection section (not illustrated) disposed at a position near the fixing side member, control section 80 controls the output of heating source 63.

In addition, when control section 80 controls the operation of pressure contact separation section 64 such that the back side supporting member is brought into pressure contact with the fixing side member, a fixing nip for conveying a sheet in a tightly sandwiching manner is formed. A toner image is secondary-transferred, and heat and pressure are applied to a sheet which has been conveyed along a sheet feeding path, at the time when the sheet passes through the nip portion. Thus, the toner image is fixed to the sheet.

Sheet conveyance section 50 includes sheet feeding section 51, sheet ejection section 52, sheet feeding path section 53, and the like.

Paper sheets (standard type sheets and special type sheets) discriminated on the basis of their weight, size and the like are stored on a predetermined type basis in respective three sheet tray units of sheet feeding section 51.

Sheet feeding path section 53 includes a plurality of conveyance roller sections that include entry roller section 531. Sheet feeding path section 53 conveys to image forming section 40 (secondary transfer section) a paper sheet fed from sheet feeding section 51 or a roll sheet fed from sheet feeding apparatus 1A. Sheet feeding path section 53 is a part of sheet feeding path 93 of image forming apparatus 1.

The roll sheet fed from sheet feeding apparatus 1A is conveyed to image forming section 40 by sheet feeding path section 53. Thereafter, a toner image on intermediate transfer belt 421 is secondary-transferred to a surface of the roll sheet at one time at the time when the roll sheet passes through transfer nip $N_T$, and then a fixing process is performed in fixing section 60. The roll sheet on which an image has been formed is ejected out of the image forming apparatus by sheet ejection section 52 provided with a sheet discharging roller section 52*a* (see FIG. 4) and the like, and then wound by roll winding section 92 of winding apparatus 1C.

Figure 4:
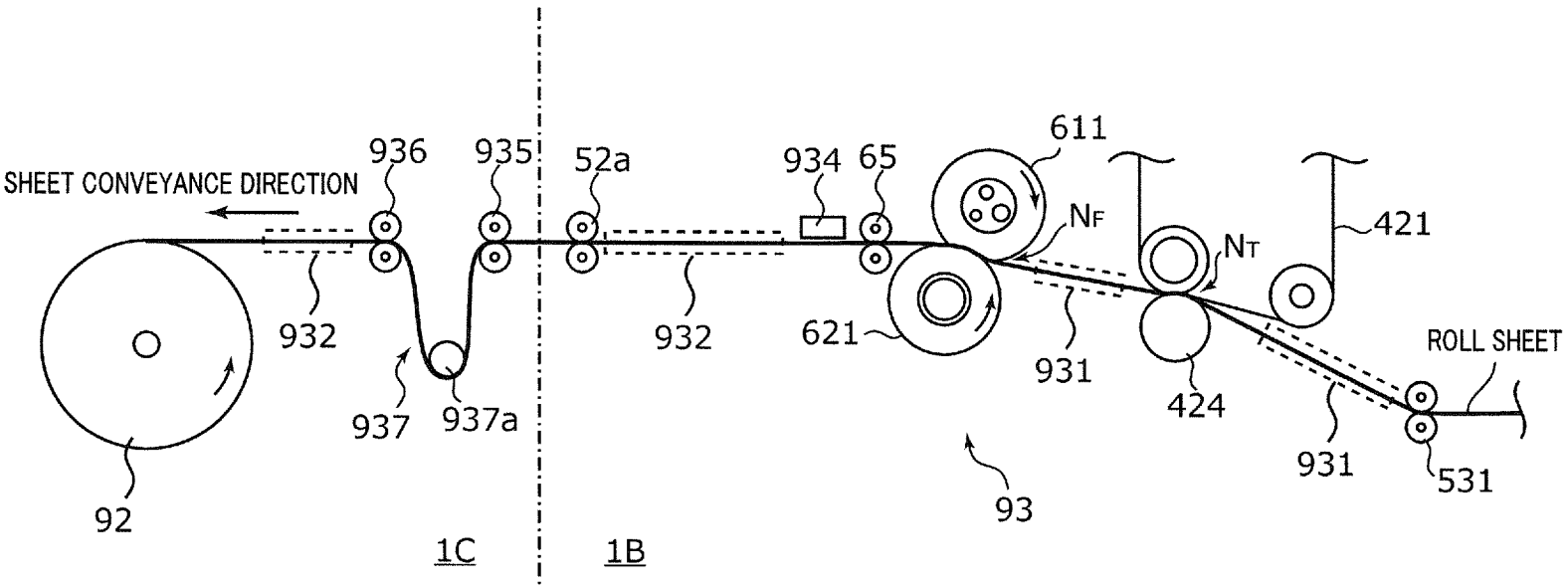
FIG. 4 is a side view illustrating a sheet feeding path of the image forming apparatus.
Figure 5:
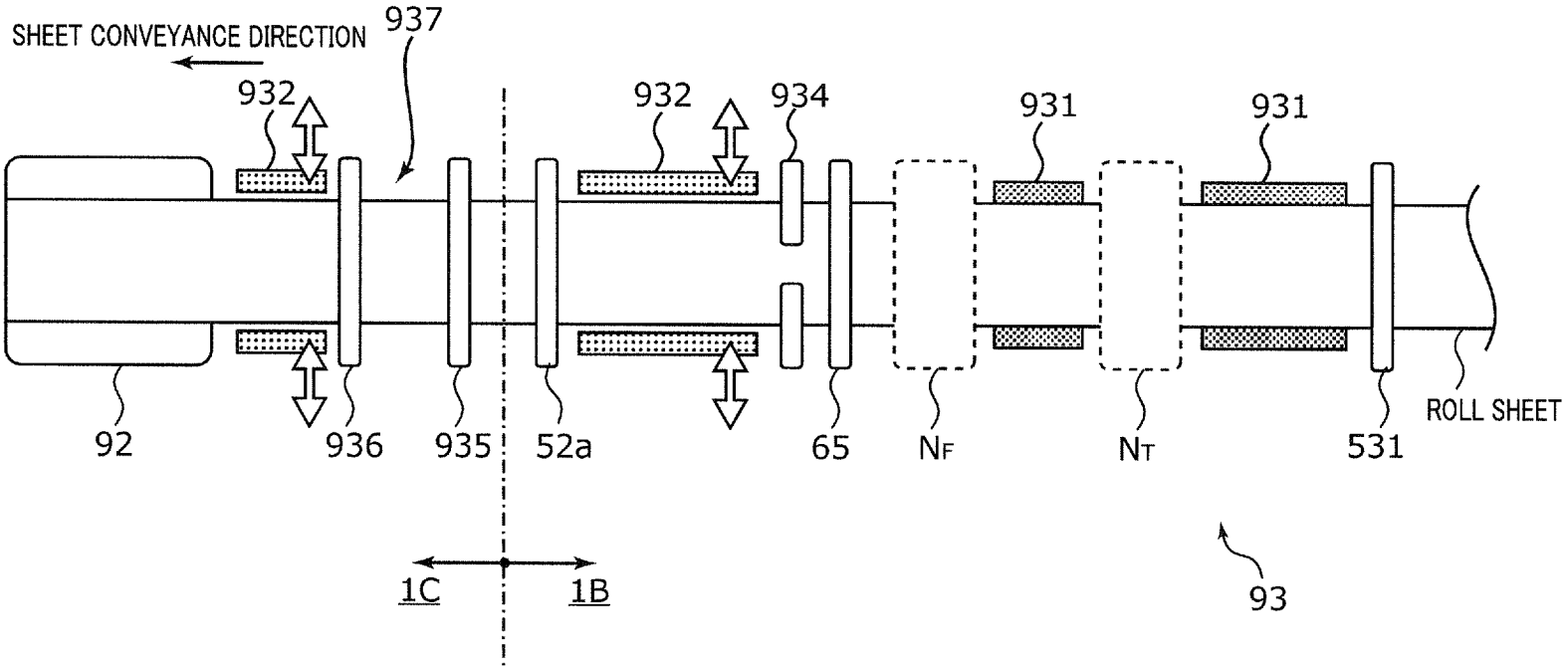
FIG. 5 is a plan view illustrating the sheet feeding path of the image forming apparatus.

FIG. 4 is a side view illustrating a sheet feeding path that leads to roll winding section 92 through secondary transfer nip $N_T$ and fixing nip $N_F$. FIG. 5 is a plan view illustrating a sheet feeding path that leads to roll winding section 92 through secondary transfer nip $N_T$ and fixing nip $N_F$.

As illustrated in FIG. 4 and FIG. 5, on the upstream side of fixing nip $N_F$ in the sheet conveyance direction, pre-fixation guide members 931 are disposed along the sheet feeding path on both sides of the sheet feeding path in the sheet width direction. In FIG. 4 and FIG. 5, pre-fixation guide members 931 are disposed to the sheet feeding path at a part that connects entry roller section 531 with secondary transfer nip $N_T$, and at a part that connects secondary transfer nip $N_T$ with fixing nip $N_F$. It is to be noted that the disposition of pre-fixation guide members 931 (the number of pre-fixation guide members 931, the positions where pre-fixation guide members 931 are disposed and the like) is not limited to the above-mentioned disposition.

Pre-fixation guide members 931 are each composed of a pair of guide plates facing each other in the sheet width direction. The pair of guide plates serving as pre-fixation guide member 931 are disposed symmetrically about the sheet-feeding center (the center of the sheet feeding path in the width direction). Preferably, pre-fixation guide member 931 has a low frictional property, and is a member in which fluororesin is provided on the surface that makes contact with a roll sheet, for example. The position of pre-fixation guide member 931 is set in advance such that the separation distance between the guide plates (hereinafter referred to as "guide width") matches the width of the roll sheet used for the image formation. Pre-fixation guide member 931 is fixed at such a position. Since a roll sheet is conveyed along pre-fixation guide member 931, meandering of the roll sheet is not caused before the roll sheet enters fixing nip $N_F$, and the center of the roll sheet (the center of the roll sheet in the width direction) matches the sheet-feeding center.

On the downstream side of fixing nip $N_F$ in the sheet conveyance direction, post-fixation guide members 932 are disposed along the sheet feeding path on both sides of the sheet feeding path in the sheet width direction. In FIG. 4 and FIG. 5, post-fixation guide members 932 are disposed to the sheet feeding path at a part that connects fixing nip $N_F$ with sheet ejection roller 52*a*, and at a part that connects pre-winding roller 936 with roll winding section 92 of winding device 1C. It is to be noted that the disposition of post-fixation guide members 932 (the number of post-fixation guide members 932, the positions where post-fixation guide members 932 are disposed and the like) is not limited to the above-mentioned disposition.

Post-fixation guide members 932 are each composed of a pair of guide plates facing each other in the sheet width direction. The pair of guide plates serving as post-fixation guide member 932 are disposed symmetrically about the sheet-feeding center. Preferably, post-fixation guide member 932 has a low frictional property as with pre-fixation guide member 931. The position of post-fixation guide member 932 is set in advance such that the guide width matches the width of the roll sheet used for image formation in the initial state. In addition, post-fixation guide member 932 is connected with guide driving section 933 through a power transmission mechanism (not illustrated), and thus the guide width can be changed.

Preferably, post-fixation guide member 932 is disposed immediately after fixing section 60. Such a configuration limits meandering of a roll sheet in image forming apparatus main body 1B, and thus the winding quality of a roll sheet can be enhanced, and damage of a roll sheet and degradation of image quality in association with the meandering can be prevented.

In addition, post-fixation guide member 932 is preferably disposed on the downstream side of buffer section 937 described later in the sheet conveyance direction, that is, at a position immediately before roll winding section 92. Such a configuration makes it possible to surely correct the position in the sheet width direction of a roll sheet which has been sufficiently cooled down and thus has a fixed sheet width (a roll sheet after shrinkage or expansion), and consequently winding of the roll sheet can be performed in an orderly fashion without causing irregularity of the ends.

On the downstream side of fixing nip $N_F$ in the sheet conveyance direction, and on the upstream side of post-fixation guide member 932 in the sheet conveyance direction (in FIG. 4 and FIG. 5, immediately after fixation output roller 65), sheet width detection sensor 934 (sheet width detection section) that detects the width of a roll sheet that has passed through fixing nip $N_F$ is disposed. Sheet width detection sensor 934 is, for example, composed of a line sensor disposed in parallel with the sheet width direction. In a line sensor, the sensor output changes at end positions of a sheet as the boundaries, and therefore the positions where the changing points of the sensor output are found are the positions of the both end portions of the roll sheet in the width direction. The width of the roll sheet that has passed through fixing section 60 can be detected on the basis of the positions of the both end portions of the roll sheet.

During image formation, control section 80 controls guide driving section 933 to operate on the basis of detection results of sheet width detection sensor 934, thereby adjusting the guide width of post-fixation guide member 932. That is, the guide width of post-fixation guide member 932 is adjusted in accordance with the variation of the width of a roll sheet due to shrinkage or expansion. Also in this case, the symmetry of the pair of guide plates serving as post-fixation guide member 932 is maintained.

In principle, the guide width of post-fixation guide member 932 is adjusted such that the guide width matches the width of a roll sheet after shrinkage or expansion. However, in the case of an image formation on a tack roll sheet (a roll sheet having a surface base material, an adhesive and a release paper), when the post-fixation guide member 932 and the roll sheet excessively make sliding contact with each other, the adhesive may leak out from the end surfaces of the roll sheet in the width direction, thus contaminating the roll sheet and post-fixation guide member 932. For this reason, when an image is formed on a tack roll sheet, it is possible to adjust the guide width to a value greater than the detected width of the roll sheet.

It is to be noted that the temperature of a tack roll sheet before the fixation process is lower than the temperature of the tack roll sheet that has passed through fixing section 60, and the adhesive is not easily leaks out from the end surfaces of the roll sheet in the width direction, and therefore pre-fixation guide member 931 may be in sliding contact with the tack roll sheet.

Winding device 1C includes, on the upstream side of roll winding section 92 in the sheet conveyance direction, buffer section 937 that gives a predetermined tensile force to a roll sheet. In FIG. 4 and FIG. 5, buffer section 937 is provided between entrance roller 935 and pre-winding roller 936.

Buffer section 937 includes tension roller 937*a* that can move vertically, for example. When tension roller 937*a* moves vertically, slackening of a roll sheet is reduced, and a proper tensile force is given to the roll sheet.

Figure 6:
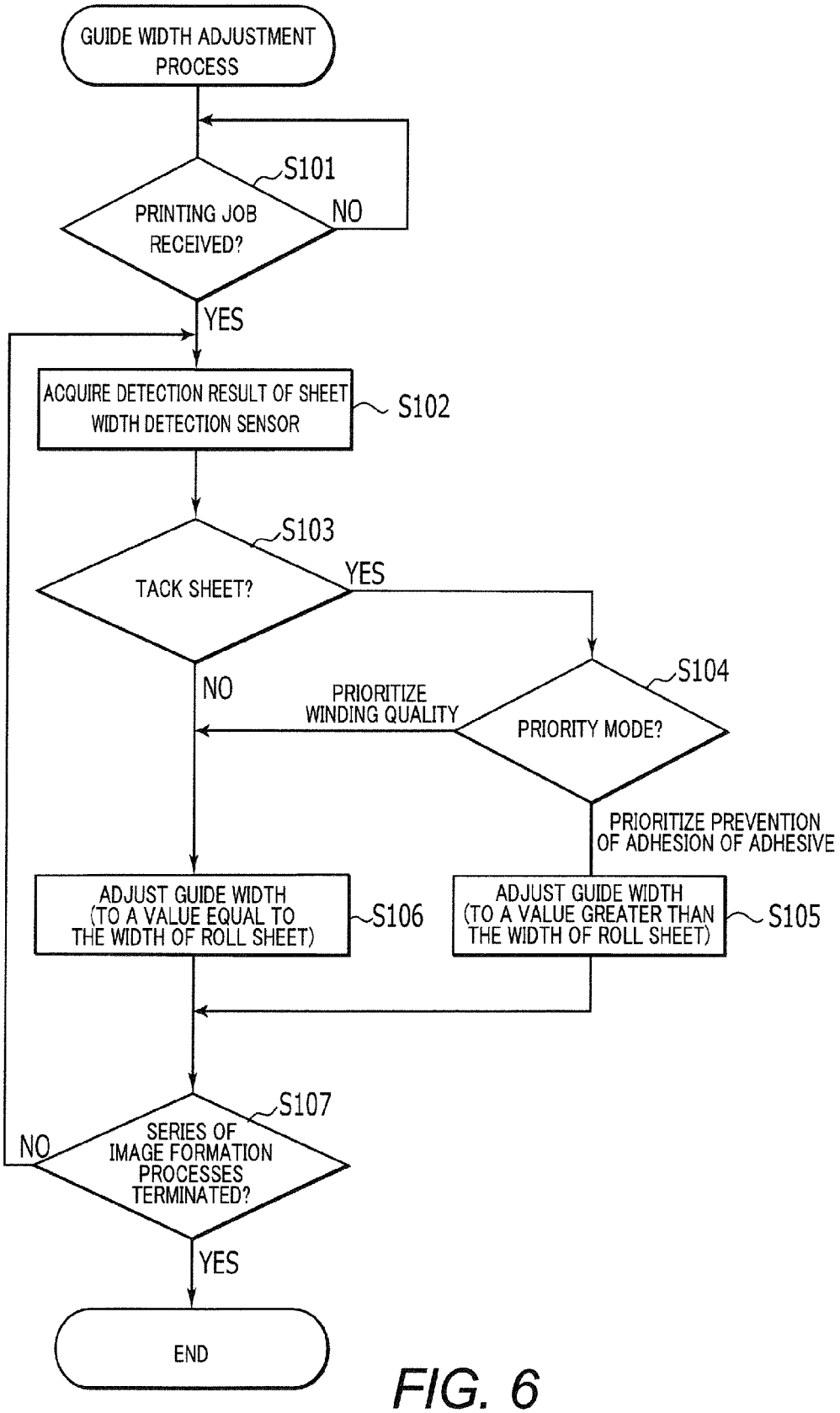
FIG. 6 is a flowchart illustrating an exemplary guide width adjustment process.

FIG. 6 is a flowchart illustrating an exemplary guide width adjustment process. This process is achieved when CPU 81 of image forming apparatus main body 1B executes a predetermined program stored in ROM 82 upon the turning on of the power of image forming apparatus 1, for example.

It is assumed that a winding quality priority mode or an adhesive adhesion prevention priority mode is set in advance at the time of the start of image formation. A user can set desired modes by operating operation display section 20.

At step S101 of FIG. 6, control section 80 determines whether a printing job has been received. When a printing job has been received ("YES" at step S101), the process is advanced to step S102.

At step S102, control section 80 acquires detection results (the width of a roll sheet after shrinkage or expansion) of the sheet width detection sensor.

At step S103, control section 80 determines whether the roll sheet in use for the image formation is a tack roll sheet. The sheet type information of the roll sheet in use for the image formation is included in the printing job, for example. When a tack roll sheet is in use for the image formation (at step S103 "YES"), the process is advanced to step S104. When a roll sheet other than a tack roll sheet is in use for the image formation (at step S103 "NO"), the process is advanced to step S106.

At step S104, control section 80 determines whether the priority mode is set to the winding quality priority mode or the adhesive adhesion prevention priority mode. When the winding quality priority mode is set, the process is advanced to step S106. When the adhesive adhesion prevention priority mode is set, the process is advanced to step S105.

At step S105, control section 80 controls the operation of guide driving section 933 to adjust the guide width of post-fixation guide member 932. At this time, control section 80 adjusts the guide width to a value slightly greater than the width of the roll sheet acquired at step S102. Such a configuration makes it possible to limit an excessive sliding contact between post-fixation guide member 932 and the roll sheet, and therefore it is possible to prevent a situation where the roll sheet and post-fixation guide member 932 are contaminated and damaged by adhesive leaked out from the end surfaces of the roll sheet in the width direction.

At step S106, control section 80 adjusts the position of post-fixation guide member 932 such that the width of the roll sheet acquired at step S102 matches the guide width. With such a configuration, the roll sheet is conveyed along post-fixation guide member 932 in the state where the sheet-feeding center matches the sheet center even when the roll sheet shrinks or expands due to the fixation process, and thus the winding quality is remarkably enhanced.

It is to be noted that when a tack roll sheet is used, the winding quality can be enhanced although the effect of preventing leakage of adhesive from the end surfaces of the roll sheet in the width direction decreases.

At step S107, control section 80 determines whether the series of the image formation processes have been terminated. The series of image formation processes are processes for forming an image based on a signal requesting image formation (for example, printing job). When the series of the image formation processes have been terminated ("YES" at step S107), the guide width adjustment process is terminated. When the series of the image formation processes have not been terminated ("NO" at step S107), the processes subsequent to step S102 are repeated.

As described, image forming apparatus 1 includes: a sheet feeding section (roll sheet feeding section 91) configured to feed a roll sheet; a sheet feeding path (93) along which a roll sheet fed from the sheet feeding section is conveyed; an image forming section (40) configured to transfer a toner image to a roll sheet conveyed along the sheet feeding path; a fixing section (60) configured to fix the toner image by applying heat and pressure to a roll sheet on which the toner image is transferred at a fixing nip ($N_F$); a winding section (roll winding section 92) configured to wind up a roll sheet on which the toner image is fixed; a guide member (post-fixation guide member 932) disposed along the sheet feeding path on both sides in a sheet width direction and on a downstream side of the fixing nip in a sheet conveyance direction; and a guide adjusting section (control section 80 and guide driving section 933) configured to adjust a guide width of the guide member in accordance with an amount of shrinkage or an amount of expansion of a roll sheet passed through the fixing nip.

To be more specific, image forming apparatus 1 includes a sheet width detection section (sheet width detection sensor 934) disposed between fixing nip ($N_F$) and the guide member (post-fixation guide member 932), and configured to detect a sheet width of a roll sheet passed through the fixing nip and the guide adjusting section (control section 80 and guide driving section 933) adjusts the guide width of the guide member on a basis of a detection result obtained by the sheet width detection section.

With image forming apparatus 1, the guide width of post-fixation guide member 932 is adjusted in accordance with the sheet width of a roll sheet shrunken or expanded by the fixation process, and thus meandering and deformation of a roll sheet after the fixation can be surely prevented. Consequently, winding of a roll sheet can be performed in an orderly fashion without causing irregularity of ends.

In addition, image forming apparatus 1 has a first priority mode (winding quality priority mode) and a second priority mode (adhesive adhesion prevention priority mode) for a case where a tack roll sheet is used for image formation, the first priority mode being configured to enhance winding quality, the second priority mode being configured to prevent adhesion of adhesive of the tack roll sheet to the guide member (post-fixation guide member 932). The guide adjusting section (control section 80 and guide driving section 933) selects one of the first priority mode and the second priority mode, and the guide adjusting section sets a guide width of the guide member to a value equal to a width of a roll sheet passed through the fixing nip when the first priority mode is selected, whereas the guide adjusting section sets the guide width of the guide member to a value greater than the width of the roll sheet passed through the fixing nip when the second priority mode is selected.

With such a configuration, in accordance with whether the user prioritizes the winding quality or prevention of adhesion of the adhesive, the guide width of post-fixation guide member 932 can be appropriately adjusted.

It is to be noted that, when a tack roll sheet is used for image formation, it is also possible to set the guide width of post-fixation guide member 932 such that the guide width is always greater than the sheet width detected by the sheet width detection section (sheet width detection sensor 934).

While the invention made by the present inventor has been specifically described based on the preferred embodiments, it is not intended to limit the present invention to the above-mentioned preferred embodiments but the present invention may be further modified within the scope and spirit of the invention defined by the appended claims.

For example, the guide adjusting section (control section 80 and guide driving section 933) may adjust the guide width of guide member (post-fixation guide member 932) on the basis of guide width data set in advance in accordance with the sheet type of the roll sheet and elapsed from the start of feeding of the sheet. The guide width data is stored in storage section 72 for example. In this case, the guide width of the guide member corresponding to the time from the start of feeding of the sheet may be set by the user by operating operation display section 20.

In addition, for example, it is also possible to use a biasing member such as a compression spring to press the guide member (post-fixation guide member 932) against the end surfaces of a roll sheet in the width direction with a small pressure force which does not cause deformation of the roll sheet, such that the guide member moves in accordance with the variation of the width of the roll sheet. In this case, the biasing member serves as the guide adjusting section of the embodiment of the present invention.

The embodiment disclosed herein is merely an exemplification and should not be considered as limitative. The scope of the present invention is specified by the following claims, not by the above-mentioned description.

It should be understood that various modifications, combinations, sub-combinations and alterations may occur depending on design requirements and other factors in so far as they are within the scope of the appended claims or the equivalents thereof.

What is claimed is:

1. An image forming apparatus comprising:

a sheet feeding section configured to feed a roll sheet;

a sheet feeding path along which a roll sheet fed from the sheet feeding section is conveyed;

an image forming section configured to transfer a toner image to a roll sheet conveyed along the sheet feeding path;

a fixing section configured to fix the toner image by applying heat and pressure to a roll sheet on which the toner image is transferred at a fixing nip;

a winding section configured to wind up a roll sheet on which the toner image is fixed;

a guide member disposed along the sheet feeding path on both sides in a sheet width direction and on a downstream side of the fixing nip in a sheet conveyance direction;

a guide adjusting section configured to adjust a guide width of the guide member in accordance with an amount of shrinkage or an amount of expansion of a roll sheet passed through the fixing nip; and a sheet width detection section disposed between the fixing nip and the guide member, and configured to detect a sheet width of a roll sheet passed through the fixing nip, wherein the guide adjusting section adjusts the guide width of the guide member on a basis of a detection result obtained by the sheet width detection section, wherein:

the image forming apparatus has a first priority mode and a second priority mode for a case where a tack roll sheet is used for image formation, the first priority mode being configured to enhance winding quality, the second priority mode being configured to prevent adhesion of adhesive of the tack roll sheet to the guide member; and the guide adjusting section selects one of the first priority mode and the second priority mode, and the guide adjusting section sets the guide width of the guide member to a value equal to a width of a roll sheet passed through the fixing nip when the first priority mode is selected, whereas the guide adjusting section sets the guide width of the guide member to a value greater than the width of the roll sheet passed through the fixing nip when the second priority mode is selected.

2. The image forming apparatus according to claim 1, further comprising an operation section for setting the priority modes in advance.

3. The image forming apparatus according to claim 1, further comprising a buffer section disposed between the fixing nip and the winding section, and configured to give a predetermined tensile force to a roll sheet, wherein the guide member is disposed at least between the buffer section and the winding section.

4. The image forming apparatus according to claim 1, wherein the guide width of the guide member matches the sheet width of the roll sheet in an initial state before the guide width is adjusted.

* * * * *